US007775356B2

(12) United States Patent
Palmer

(10) Patent No.: US 7,775,356 B2
(45) Date of Patent: Aug. 17, 2010

(54) LAPTOP COMPUTER CASE AND STAND

(76) Inventor: Russell K. Palmer, 4815 Tranquility Bay Dr., St. George, UT (US) 84790

( * ) Notice: Subject to any disclaimer, the term of this patent is extended or adjusted under 35 U.S.C. 154(b) by 0 days.

(21) Appl. No.: 12/351,961

(22) Filed: Jan. 12, 2009

(65) Prior Publication Data

US 2009/0178938 A1 Jul. 16, 2009

Related U.S. Application Data

(60) Provisional application No. 61/010,732, filed on Jan. 11, 2008.

(51) Int. Cl.
*B65D 85/00* (2006.01)

(52) U.S. Cl. ..... 206/320; 206/45.23; 206/45.24; 206/755

(58) Field of Classification Search ..... 206/45.2, 206/45.23, 45.24, 45.28, 45.29, 305, 320, 206/523, 751, 752, 754, 755, 766, 576, 774; 361/679.27; 248/346.01, 676, 688, 454, 248/456

See application file for complete search history.

(56) References Cited

U.S. PATENT DOCUMENTS 993,330 A * 5/1911 Walker ..... 206/45.28
2,330,585 A * 9/1943 Holstein et al. ..... 206/735
4,542,847 A * 9/1985 Lindstrom ..... 206/766
5,445,266 A 8/1995 Prete et al.
5,607,054 A 3/1997 Hollingsworth
5,871,094 A 2/1999 Leibowitz
5,927,487 A * 7/1999 Whittle et al. ..... 206/45.2
6,352,151 B1 * 3/2002 Stewart ..... 206/45.29
6,545,864 B2 4/2003 Davis, IV
7,327,560 B1 2/2008 Tabasso et al.
2004/0134812 A1 * 7/2004 Yeh ..... 206/320
2008/0041683 A1 2/2008 Dorquez

* cited by examiner

*Primary Examiner*—Luan K Bui
(74) *Attorney, Agent, or Firm*—James Ray & Assoc

(57) ABSTRACT

A laptop computer carrying case and stand includes a substantially planar bottom panel, two planar side walls parallel to one another and fixedly attached perpendicular to and adjacent opposing edges of the planar bottom panel, and the side walls have top edges distal the bottom panel. A substantially planar rear wall is fixedly attached perpendicular to the planar bottom panel and the two planar side walls. A top member having at least two substantially planar and rigid sections is hingedly connected adjacent a top edge of the rear wall panel and hingedly attached at an opposing edge to a second of the rigid sections. A top member positioning means is included for removably engaging the sections of said top member in at least one inverted V pattern for the purpose of supporting a laptop computer an angle to a user.

11 Claims, 4 Drawing Sheets

LAPTOP COMPUTER CASE AND STAND

CROSS REFERENCE TO RELATED APPLICATION

This patent application is related to and claims priority from U.S. Provisional Patent Application Ser. No. 61/010,732 filed Jan. 11, 2008.

FIELD OF THE INVENTION

The present invention relates, in general, to protective carrying cases for portable computers and, more particularly, this invention relates to a combination carrying case and adjustable stand for laptop computers.

BACKGROUND OF THE INVENTION

Prior to the conception and development of the present invention, users of portable or laptop computers have had a multitude of choices for various types of carrying cases for their laptops that make them easier to transport, and also protect, their computers. The main advantage to laptop computers is ease of moving them from one using location to another. Prete et al in U.S. Pat. No. 5,445,266 and Hollingsworth in U.S. Pat. No. 5,607,054 disclose soft-side laptop carrying cases which allow the user to work at the computer within an opened carrying case. The Prete design allows for various viewing angles of the screen, but it applies to screens detached from the keyboard, something not found today. Present day laptops enable the attached LCD screen to be rotated at a hinge to a plurality of viewing angles; hence, the Prete case offers no advantage to laptops on the market since the year 2000. The Hollingsworth case offers one slightly inclined position for the keyboard, but that is all.

Numerous varieties of computer stands have also been disclosed, such as those of Davis in U.S. Pat. No. 6,545,864 and Tabasso et al in U.S. Pat. No. 7,327,560. These, however, do not provide for transport and protection of the computer itself.

Leibowitz in U.S. Pat. No. 5,871,094 discloses a laptop computer case with a hinged lid that converts the carrier to a stand with just one angle of incline. It is designed for resting on a person's legs. In U.S. Patent Application Publication 2008/0041683, a combination laptop desk and carrying case is disclosed. It is rather bulky and rests on the floor forming its own desk. This large desk/carrying case combination would not be practical for the vast majority of laptop computer owners.

SUMMARY OF THE INVENTION

The present invention provides a laptop computer carrying case and stand, and includes a substantially planar bottom panel, two planar side walls parallel to one another and fixedly attached perpendicular to and adjacent opposing edges of the planar bottom panel, and the side walls have top edges distal the bottom panel. A substantially planar rear wall is fixedly attached perpendicular to the planar bottom panel and the two planar side walls. A top member having at least two substantially rigid sections is hingedly connected adjacent a top edge of the rear wall panel and hingedly attached to another of the rigid sections at the opposite edge to the first hinged connection. A top member positioning means is included for removably engaging the sections of said top member in at least one inverted V pattern for the purpose of supporting a laptop computer an angle to a user.

In one alternative embodiment, the top lid member consists of two hinged members. In a third embodiment, the top lid member has four hinged sections, and the back side of one section has a padded wrist rest attached.

OBJECTS OF THE INVENTION

It is, therefore, one of the primary objects of the present invention to provide a carrying case for laptop or notebook computers that coverts into a convenient stand for supporting the computer at an angle to a supporting table or desk top.

Another object of the present invention is to provide a sturdy laptop computer stand that allows the user a multitude of angle positions for both the keyboard and the display.

Still another object of the present invention is to provide a hard shell protective computer carrying case that doubles as a desk-top stand for a portable computer.

Yet another object of the present invention is to provide a laptop computer stand that converts to a padded hard-shell case for greater protection.

In addition to the various objects and advantages of the present invention described with some degree of specificity above, it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
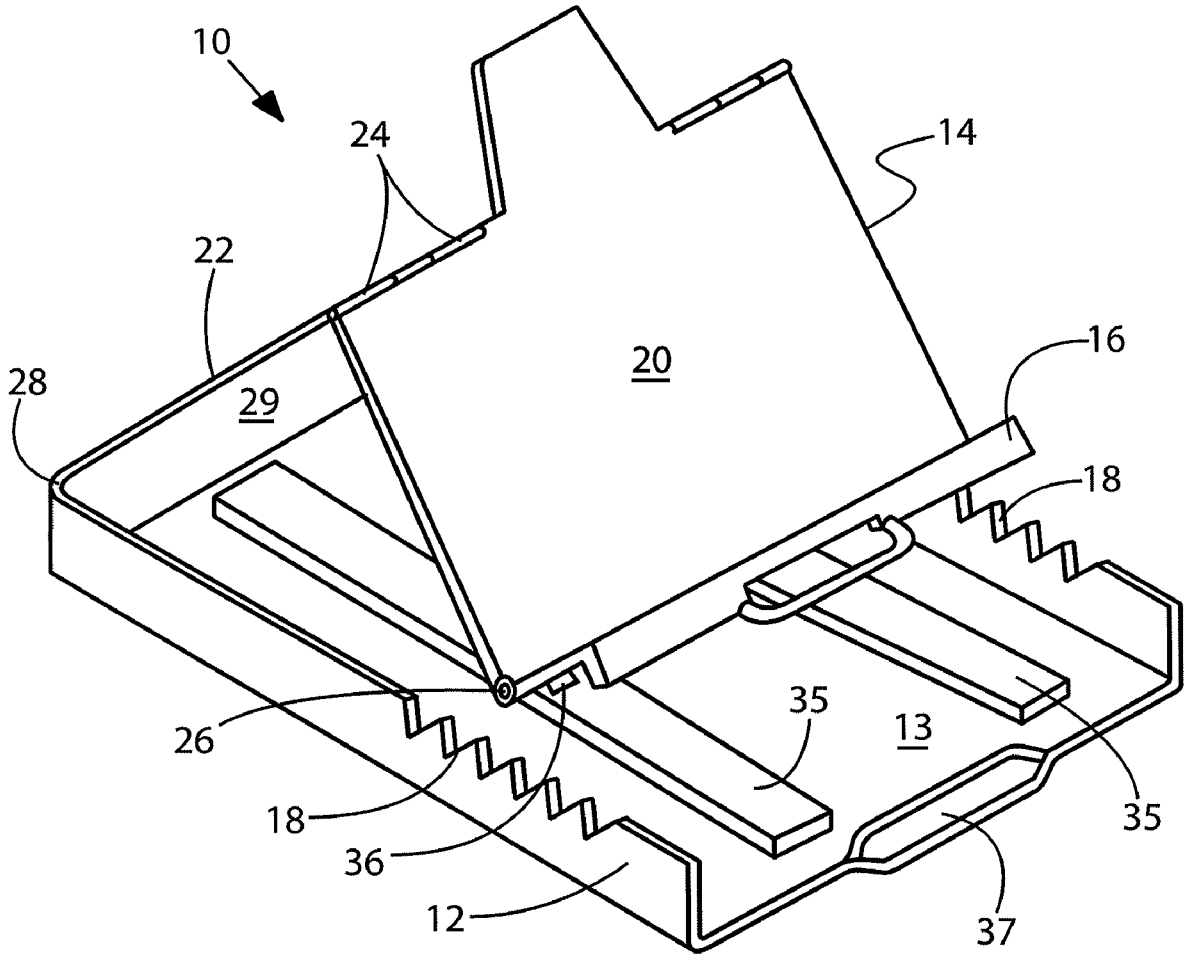
FIG. 1 is a perspective view of one embodiment of the present invention.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Referring initially to FIG. 1, the present invention, generally represented as 10, is shown in a perspective view. A box-like structure has a bottom panel 13, two side walls 12, and a back wall 29. Padding 35, such as foam or rubber, is optionally attached to the interior of the box. The top or lid of the box typically consists of three hinged sections. The rear panel 22 is attached to the top edge of the rear wall 29 with a hinge or hinges 28. The midsection panel 14 is connected to the opposing edge of the rear panel 22 with hinges 24. The third, but optional, section of the lid is an L-shaped door 16 which is hingedly connected to panel 20 with hinges 26. As illustrated in FIG. 3, the L-shaped door 16 can cover the front opening and swings up or down as needed for storing and removing a folded closed laptop computer. For use of the laptop computer in a convenient position, the two planar sections of the lid, 14 and 22, are raised into an inverted V-shape and the edge of panel 14 where hinge 26 attaches is then engaged with notches or serrations 18 along at least a portion of the side wall edges. Optionally, the front edges of bottom 13 and door 16 will have oval-like openings 37 to form a carrying handle that also keeps the lid closed when transporting the laptop computer. In lieu of the L-shaped door 16 and the handle opening 37, an arrangement such as that shown in FIG. 4 can be utilized. An alternative method to engage the top lid in a V-shape is to have tab extensions 36 planar to the lid panel 14 such that they engage frictionally with elastomeric padding strips 35 so as to maintain the V shape. In either case, the main body of the laptop computer can then rest on surface 20 of hinged panel 14 at angles adjustable by the user, and as shown in FIG. 2.

Figure 2:
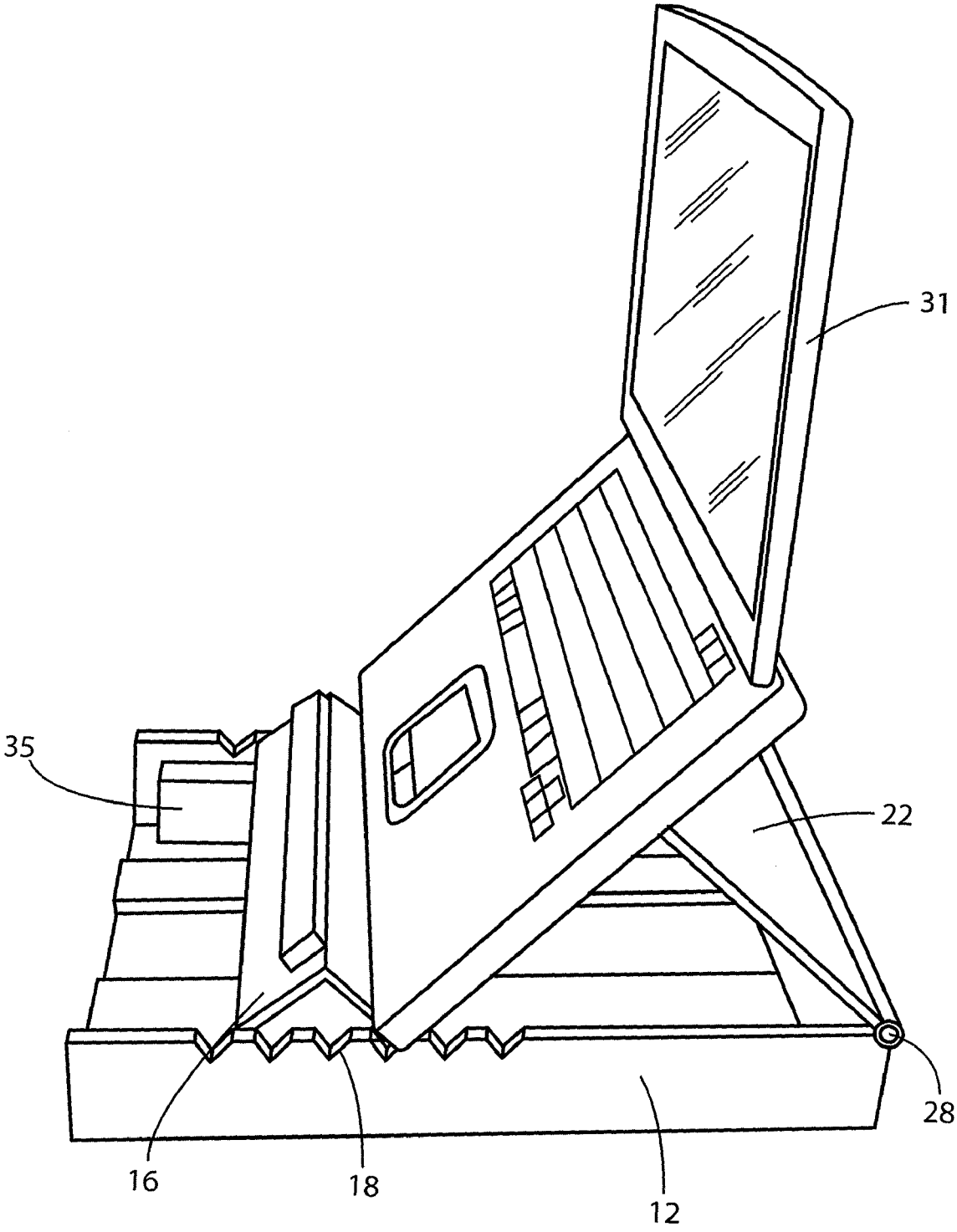
FIG. 2 is a perspective view of the present invention in use supporting a laptop computer.
Figure 3:
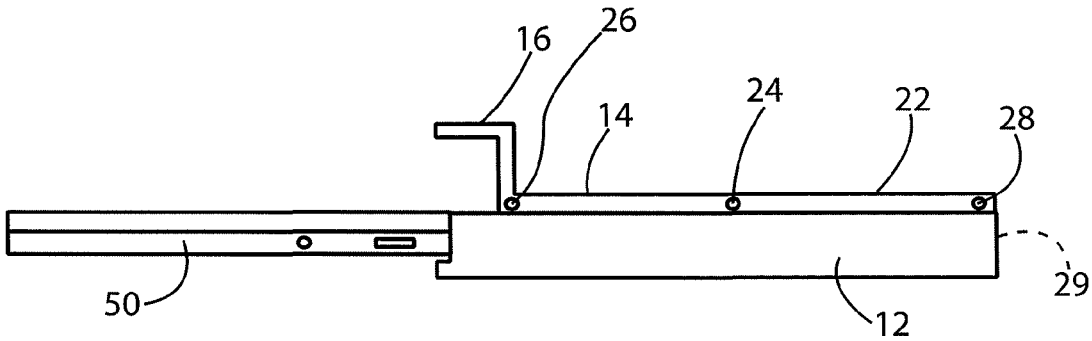
FIG. 3 is a side elevation view of the present invention as a carrying case.

FIG. 2 illustrates the use of the present invention with a laptop computer 31 conveniently placed for viewing and usage. The rear lid panel 22 can be seen in the raised position by rotating around hinge 28, while the computer body covers the middle section of the lid. The front door 16 cradles the bottom edge of the computer. The hinged edge of the door 16 and the midsection panel engage with serrations 18 along the top edge of side panel 12 to hold the desired slant. The hinged edge of the door 16 and the midsection panel engage with serrations 18 along the top edge of side panel 12 to hold the desired slant. Interior padding 35 is placed on some portions of the interior surfaces to protect the laptop 31 during transport.

FIG. 3 provides a side elevation view illustrating how the present invention would be used for storage and transport of a typical laptop or notebook computer 50. The hinged door 16 would be rotated up to enable the computer to be slid in or out between the side walls 12. The top lid panels 14 and 22 are attached with hinges 24, 26, and 28.

Figure 4:
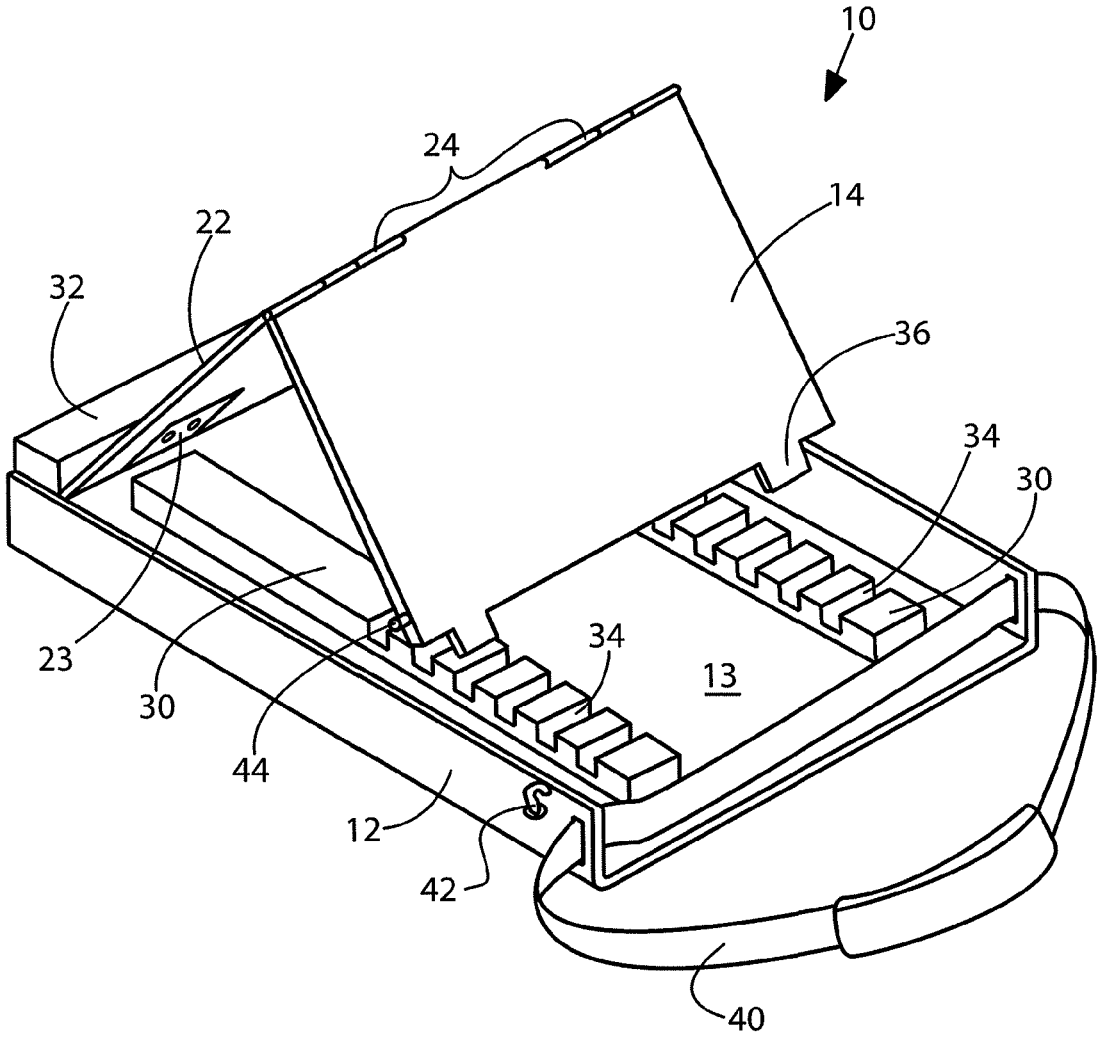
FIG. 4 is a perspective view of an alternative embodiment of the present invention.

FIG. 4 provides a perspective view of an alternative embodiment of the present invention. The box-like carrying case has a bottom panel 13, two side walls 12, and a rear wall not visible. An elongated beam member 34 is disposed along the top edge of the rear wall, and it also attaches to a rear top portion of each side wall 12. The top lid has two hingedly movable sections, 14 and 22. Top lid panel 22 is connected to the elongated beam member 32 with hinge or hinges 23 on the underside of beam 32. Lid panel member 14 is hingedly connected at an opposing edge to panel 22 at hinges 24, and it has one or two planar extension tabs 36 removed slightly inward from the unhinged corners. These extension tabs engage with padding strips 30 having multiple notches or serrations 34. If the padding strips are sufficiently rough and resilient, the notches will not be needed. This allows the user to select from multiple tilt angles with the laptop computer body resting on panel 22 and against the beam member 32. On the end opposite the beam, a carrying strap 40 both retains the computer during transport and provides the user a carrying aid. A latch 42 engages with a pin 44 to help keep the lid in the closed position.

Figure 5:
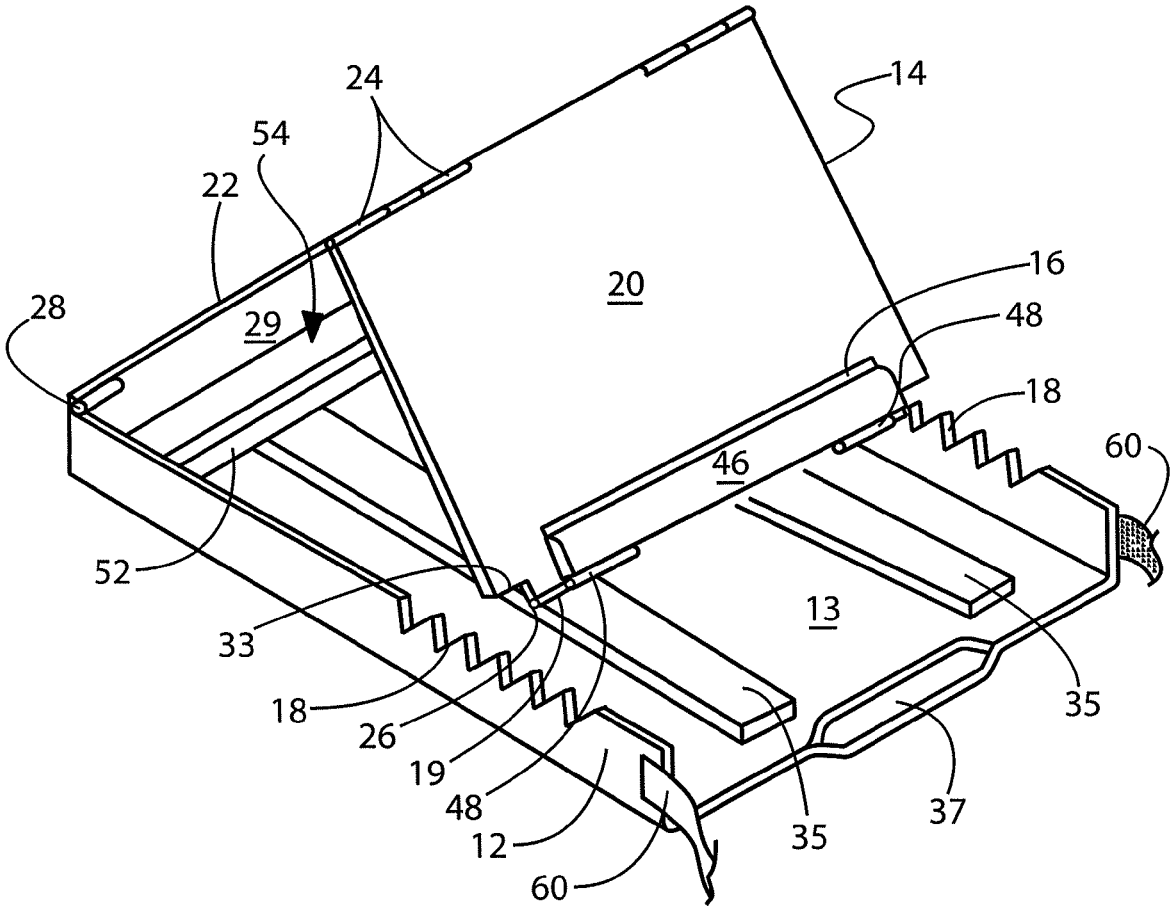
FIG. 5 provides a perspective view of a third embodiment of the present invention.

FIG. 5 provides a perspective view of a third embodiment of the present invention. This embodiment is similar to that depicted in FIG. 1, but the width of the case and bottom panel 13 is now greater than that of most common laptop computers, and the lid has four hinged sections instead of three. The top lid panel 14 now has notches 33 at the unhinged corners, and these corners still engage with serrations 18 along the top edges of the side walls 12. Hinge 26 connects the narrow hinged piece 19 to the bottom edge of panel 14, and the fourth lid member 16 connects to the other edge of section 19 with hinge 48, which must permit at least 270-degree rotation. The back side of hinged section 16 has a resilient elongated pad 46 attached for the purposes of interior padding and also to serve as a wrist rest during typing on the laptop keyboard. The length of sections 19 and 16 are slightly less than the separation of side walls 12 so that they can fit inside the case when the panel 14 engages with the serrations 18. An interior divider 52 forms an accessory storage compartment 54. Hook and loop fasteners 60 are attached to the outside of the side walls 18 and the lid section 16 to hold the lid in the closed position. One or more padding strips 35 are optionally included for added protection during transport.

Figure 6:
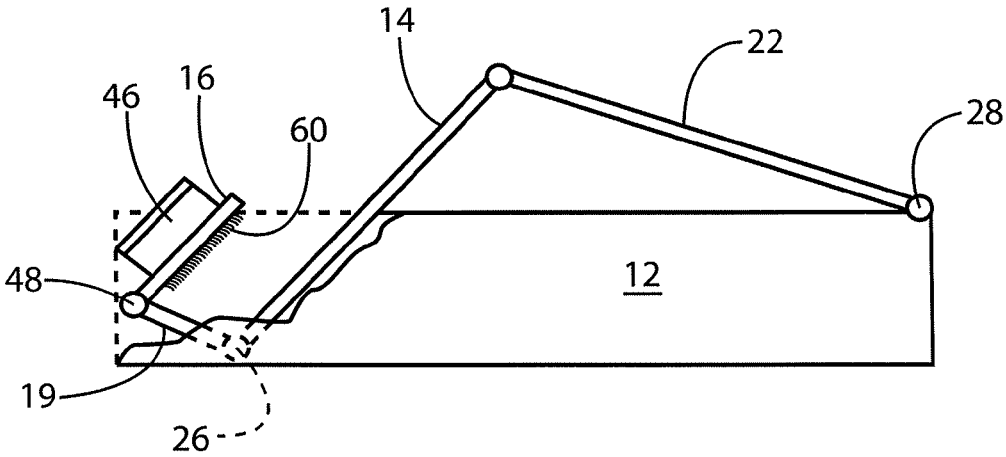
FIG. 6 is a side elevation view, in partial cut away section, of the third embodiment of the present invention.

FIG. 6 is a side elevation view, partially cut away, showing another view of the third embodiment presented in FIG. 5. A portion of lid panel 14 and all of sections 19 and 16 can fit between the side walls 12. When section 16 is rotated around the hinge 48 about 270 degrees from its door position, it forms a channel with section 19 for the bottom edge of the laptop. The pad 46 then is in a good position to be a wrist rest while typing on the keyboard, which is positioned as shown on FIG. 2.

While a presently preferred and various alternative embodiments of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

What is claimed is:

1. A laptop computer carrying case and stand comprising:

a) a substantially rigid box having:

i) a substantially planar bottom panel of a predetermined width and a predetermined length;

ii) two substantially planar side walls substantially parallel to one another and fixedly attached substantially perpendicular to and adjacent opposing edges of said planar bottom panel, said side walls having top edges distal said bottom panel;

iii) a substantially planar rear wall fixedly attached substantially perpendicular to said planar bottom panel and said two planar side walls;

iv) a top member having at least two substantially rigid planar sections, wherein a first of said sections is hingedly connected adjacent a top edge of said rear wall and hingedly attached at an opposing edge to a second of said rigid sections; and b) a positioning means having a first portion disposed at predetermined locations on one of said bottom panel and at least one said side wall and a second portion disposed on said second section of said top member for removably engaging said first and second sections of said top member in multiple inverted V patterns for supporting such laptop computer in at least one predetermined angle to a user.

2. A laptop computer carrying case and stand comprising:

a) a substantially rigid box having:

i) a substantially planar bottom panel of a predetermined width and a predetermined length;

ii) two substantially planar side walls substantially parallel to one another and fixedly attached substantially perpendicular to and adjacent opposing edges of said planar bottom panel, said side walls having top edges distal said bottom panel;

iii) a substantially planar rear wall fixedly attached substantially perpendicular to said planar bottom panel and said two planar side walls;

iv) a top member having at least two substantially rigid planar sections, wherein a first of said sections is hingedly connected adjacent a top edge of said rear wall and hingedly attached at an opposing edge to a second of said rigid sections; and b) a positioning means having a first portion disposed at predetermined locations on one of said bottom panel and at least one said side wall and a second portion disposed on said second section of said top member for removably engaging said first and second sections of said top member in multiple inverted V patterns for supporting such laptop computer in at least one predetermined angle to a user; and c) padding disposed on an at least one interior surface of said rigid box.

3. The laptop computer carrying case and stand according to claim 2, wherein said rigid box further includes at least one of a carrying handle and a carrying strap disposed at an end opposite said rear wall.

4. The laptop computer carrying case and stand according to claim 2, wherein said top member positioning means are serrations along at least part of said top edges of said side walls.

5. The laptop computer carrying case and stand according to claim 2, wherein said positioning means for said top member are notches perpendicular to said side walls and integral to said padding on an interior surface of said bottom panel, said notches engageable with at least one tab extension on said second section of said top member.

6. The laptop computer carrying case and stand according to claim 2, wherein said predetermined width is between about 8 and 24 inches.

7. The laptop computer carrying case and stand according to claim 2, wherein said predetermined length is between about 8 and 30 inches.

8. A laptop computer carrying case and stand comprising:

a) a substantially rigid box having:

i) a substantially planar bottom panel of a predetermined width and a predetermined length;

ii) two substantially planar side walls substantially parallel to one another and fixedly attached substantially perpendicular to and adjacent opposing edges of said planar bottom panel, said side walls having top edges distal said bottom panel;

iii) a substantially planar rear wall fixedly attached substantially perpendicular to said planar bottom panel and said two planar side walls;

iv) a top member having at least three substantially rigid planar sections, wherein a first of said sections is hingedly connected adjacent a top edge of said rear wall and hingedly attached at an opposing edge to a second of said rigid sections with a third panel hingedly attached to said second rigid section at an edge of said second rigid section parallel said opposing edge; and b) a top member positioning means disposed along at least part of said top edges of said side walls for removably engaging said first and second sections of said top panel in at least one inverted V pattern for supporting said laptop computer in at least one predetermined angle to a user.

9. The laptop computer carrying case and stand according to claim 8, wherein said top member has four hinged sections, wherein a section most distal said rear panel has a backside at least partially covered with resilient padding.

10. The laptop computer carrying case and stand according to claim 8, wherein said predetermined width is between about 8 and 24 inches.

11. The laptop computer carrying case and stand according to claim 8, wherein said predetermined length is between about 8 and 30 inches.

* * * * *